US008820277B2

(12) United States Patent
Moon et al.

(10) Patent No.: US 8,820,277 B2
(45) Date of Patent: Sep. 2, 2014

(54) ENGINE ASSEMBLY INCLUDING CYLINDER HEAD OIL GALLERY

(75) Inventors: Joseph J. Moon, Clawson, MI (US); Kevin M. Luchansky, Sterling Heights, MI (US); Mark Arthur Jarrett, Davison, MI (US); Robert Jack Gallon, Northville, MI (US); William F. Miller, III, Beverly Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 423 days.

(21) Appl. No.: 13/042,852

(22) Filed: Mar. 8, 2011

(65) Prior Publication Data

US 2012/0227688 A1 Sep. 13, 2012

(51) Int. Cl.

| | |
|---|---|
| ***F01L 1/18*** | (2006.01) |
| ***F01L 1/34*** | (2006.01) |
| ***F01L 13/00*** | (2006.01) |
| ***F01L 1/24*** | (2006.01) |
| *F01L 1/053* | (2006.01) |
| *F01M 9/10* | (2006.01) |
| *F01L 1/047* | (2006.01) |

(52) U.S. Cl.

CPC ..... *F01L 1/2405* (2013.01); *F01L 2001/0537* (2013.01); *F01M 9/104* (2013.01); *F01L 2810/02* (2013.01); *F01L 13/0036* (2013.01); *F01L 2820/033* (2013.01); *F01L 1/185* (2013.01); *F01L 2001/0476* (2013.01)

USPC ..... 123/90.15; 123/90.45

(58) Field of Classification Search

CPC ..... F01L 1/185; F01L 1/34; F01L 13/0036; F01L 2001/0476; F01L 2001/0537; F01L 2820/0033; F01L 2810/02; F01M 9/104

USPC ..... 123/90.1, 90.12, 90.13, 90.45, 193.5, 123/195 R, 90.15, 90.33–90.38; 29/888.01, 29/888.06; 60/626

See application file for complete search history.

(56) References Cited

U.S. PATENT DOCUMENTS

| | | | | |
|---|---|---|---|---|
| 4,709,667 | A * | 12/1987 | Ichihara et al. | 123/90.34 |
| 5,031,586 | A * | 7/1991 | Masuda et al. | 123/90.27 |
| 5,361,733 | A * | 11/1994 | Spath et al. | 123/90.16 |

(Continued)

FOREIGN PATENT DOCUMENTS

| | | | |
|---|---|---|---|
| DE | 10041975 | A1 * | 3/2001 |
| DE | 10040119 | A1 * | 2/2002 |

OTHER PUBLICATIONS

English Language Translation of DE 10040119 A1.*
English Language Translation of DE 10041975 A1.*

(Continued)

*Primary Examiner* — Kenneth Bomberg
*Assistant Examiner* — Jason T Newton
(74) *Attorney, Agent, or Firm* — Harness, Dickey & Pierce, P.L.C.

(57) ABSTRACT

A cylinder head assembly includes a first member coupled to an engine block and a second member coupled to the first member. The first member defines a first port in communication with a first cylinder and a second port in communication with a second cylinder. The second member defines a longitudinally extending portion located on a first lateral half of the first member. A first control passage and a second control passage are defined between the first member and the longitudinally extending portion of the second member. The second member defines a wall separating the first and second control passages from one another.

19 Claims, 6 Drawing Sheets

(56) References Cited

U.S. PATENT DOCUMENTS

| | | | | |
|---|---|---|---|---|
| 5,458,099 | A * | 10/1995 | Koller et al. | 123/193.5 |
| 5,609,129 | A * | 3/1997 | Hauf et al. | 123/193.5 |
| 6,484,683 | B2 * | 11/2002 | Zielke | 123/193.5 |
| 6,584,942 | B1 | 7/2003 | Albertson et al. | |
| 7,007,641 | B1 * | 3/2006 | Kryglowski et al. | 123/90.11 |
| 7,059,291 | B2 * | 6/2006 | Ueno et al. | 123/193.5 |
| 7,779,803 | B2 * | 8/2010 | Yamamoto et al. | 123/90.39 |
| 2006/0075980 | A1 | 4/2006 | Kim et al. | |
| 2008/0127923 | A1 * | 6/2008 | Yamamoto et al. | 123/90.39 |
| 2009/0000585 | A1 * | 1/2009 | Sasaki et al. | 123/90.45 |
| 2009/0013949 | A1 * | 1/2009 | Kumagai et al. | 123/90.38 |
| 2009/0205601 | A1 | 8/2009 | Baker | |
| 2010/0065012 | A1 * | 3/2010 | Fujii et al. | 123/195 R |
| 2010/0192887 | A1 * | 8/2010 | Iwata | 123/90.17 |
| 2010/0313838 | A1 * | 12/2010 | Yoon et al. | 123/90.33 |
| 2011/0079192 | A1 * | 4/2011 | Hiramatsu et al. | 123/90.34 |

OTHER PUBLICATIONS

English Language Translation of DE 10040119 A1, Jan. 25, 2013.*
English Language Translation of DE 10041975 A1, Jan. 25, 2013.*

* cited by examiner

ENGINE ASSEMBLY INCLUDING CYLINDER HEAD OIL GALLERY

FIELD

The present disclosure relates to engine assemblies including variable valve lift arrangements.

BACKGROUND

This section provides background information related to the present disclosure which is not necessarily prior art.

Internal combustion engines may combust a mixture of air and fuel in cylinders and thereby produce drive torque. Combustion of the air-fuel mixture produces exhaust gases. Valve lift mechanisms may control opening and closing of intake and exhaust valves to control air flow to the combustion chamber and exhaust flow from the combustion chamber. Variable valve timing mechanisms may be used to adjust the opening and/or closing of intake and/or exhaust valves.

SUMMARY

An engine assembly may include an engine block, a cylinder head assembly, a first valve, a second valve, a first valve lift mechanism, a second valve lift mechanism and a camshaft. The engine block may define a first cylinder and a second cylinder. The cylinder head assembly may include a first member coupled to the engine block and a second member coupled to the first member.

The first member may define a first port in communication with the first cylinder and a second port in communication with the second cylinder. The second member may define a longitudinally extending portion located on a first lateral half of the first member. A first control passage and a second control passage may be defined between the first member and the longitudinally extending portion of the second member. The second member may define a wall separating the first and second control passages from one another.

The first valve may be located in the first port and the second valve may be located in the second port. The first valve lift mechanism may be supported on the cylinder head assembly and engaged with the first valve and in communication with the first control passage. The second valve lift mechanism may be supported on the cylinder head assembly and engaged with the second valve and in communication with the second control passage. The camshaft may be supported on the cylinder head assembly and engaged with the first and second valve lift mechanisms.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
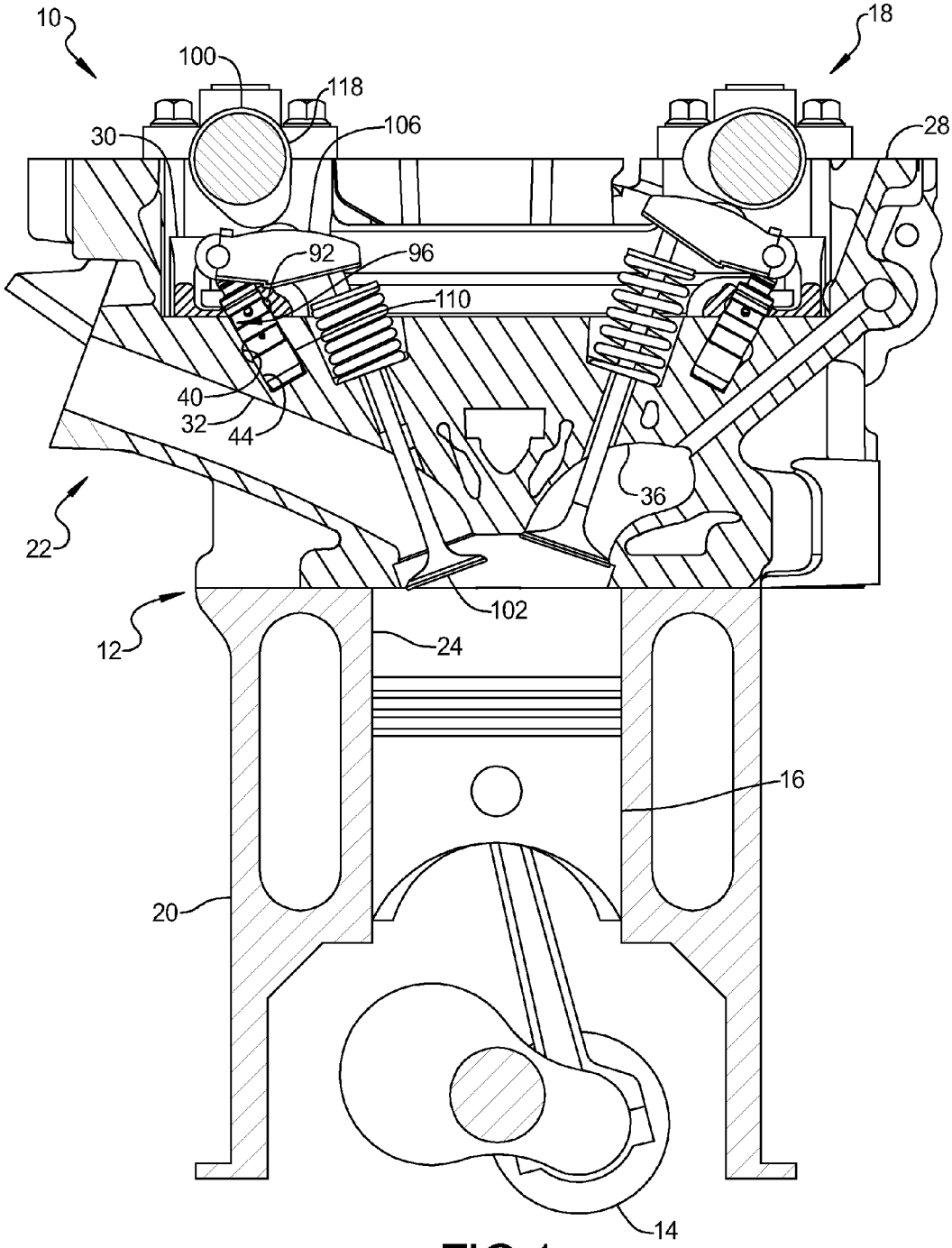
FIG. 1 is a schematic section view of an engine assembly according to the present disclosure.
Figure 2:
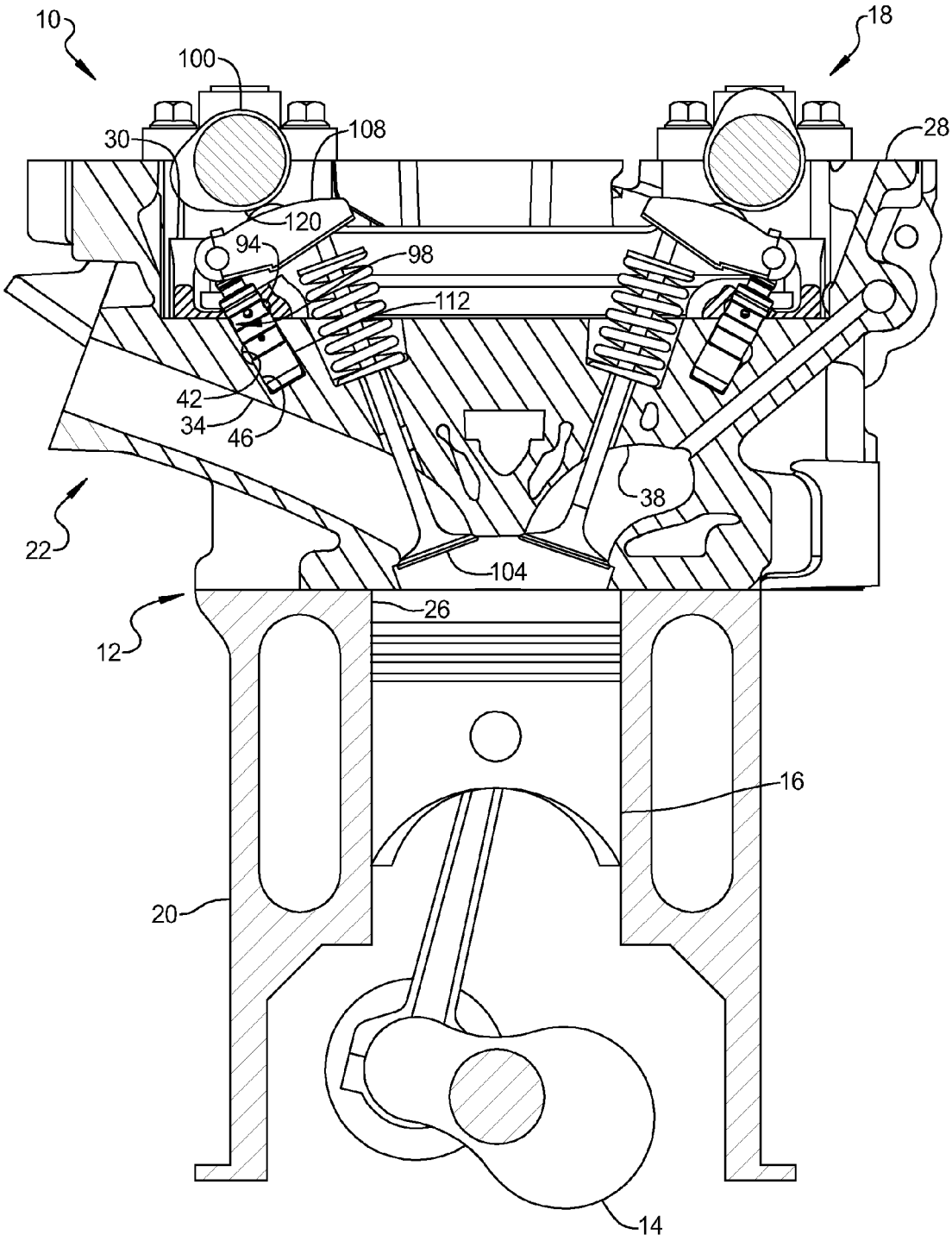
FIG. 2 is an additional schematic section view of the engine assembly of FIG. 1.
Figure 3:
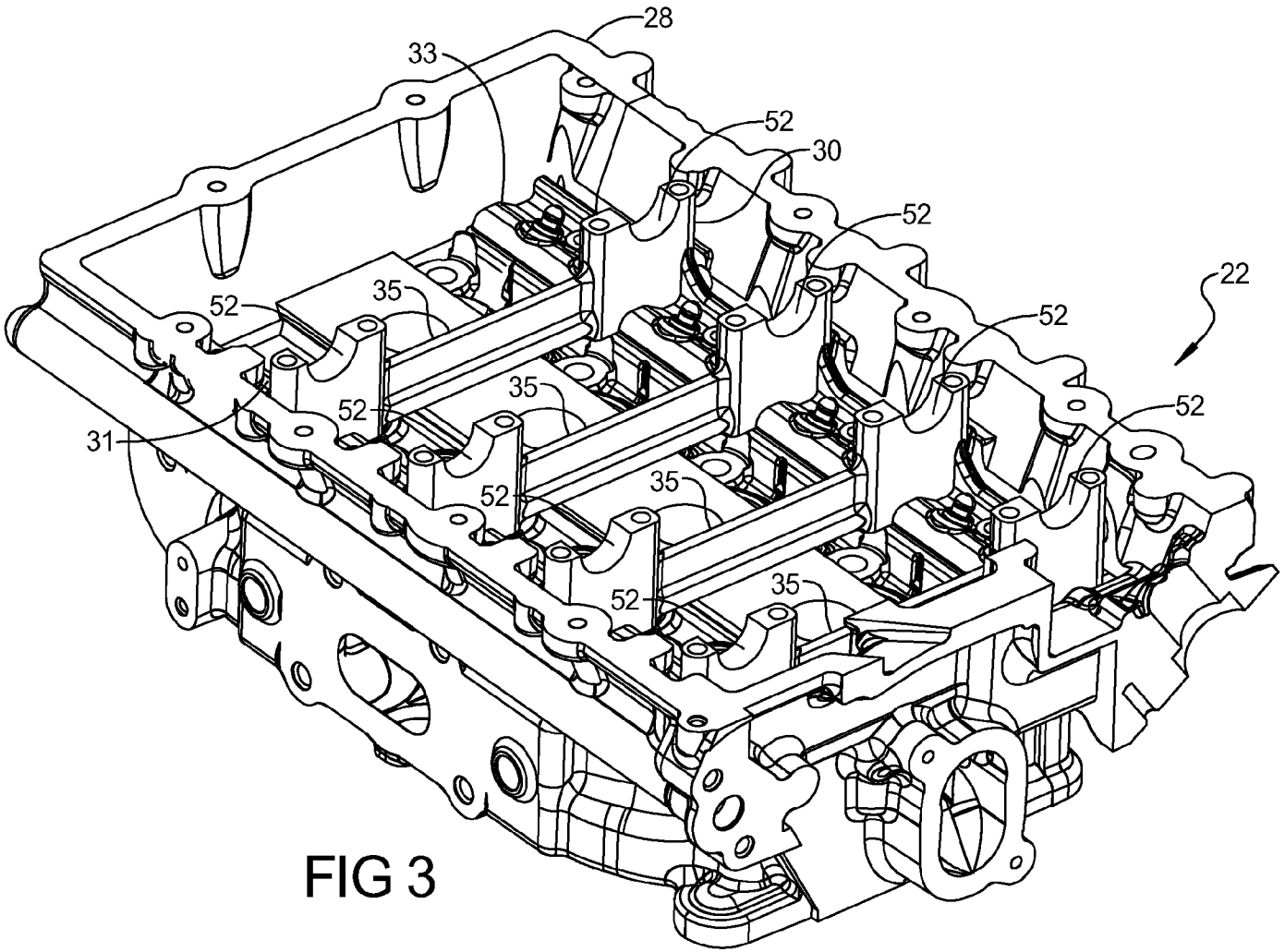
FIG. 3 is a perspective view of the cylinder head assembly from the engine assembly of FIGS. 1 and 2.
Figure 4:
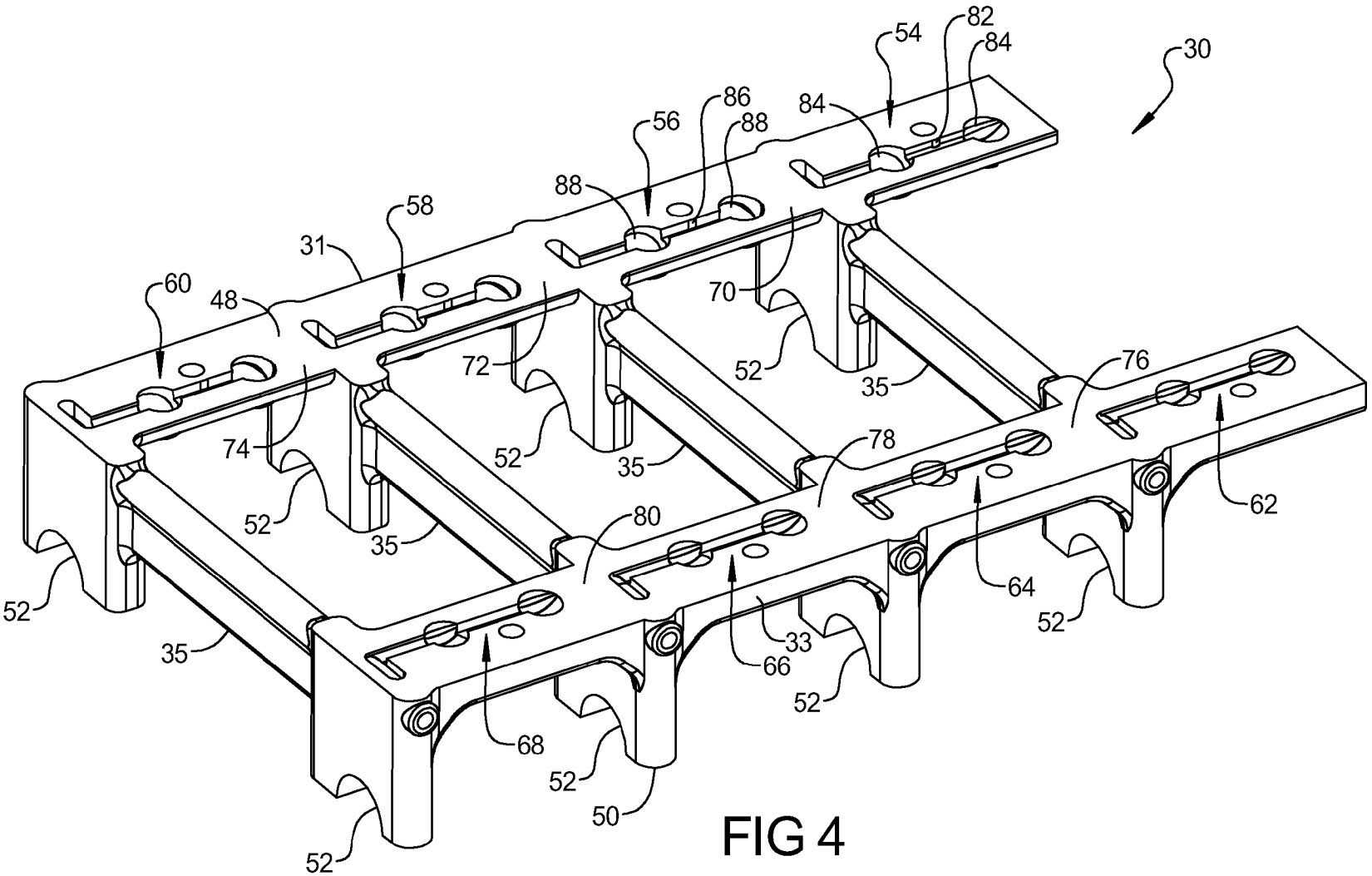
FIG. 4 is a perspective view of a portion of the cylinder head assembly of FIG. 3.

With reference to FIGS. 1-3, an engine assembly 10 is illustrated and may include an engine structure 12, a crankshaft 14, pistons 16, and a valvetrain assembly 18. The engine structure 12 may include an engine block 20 and a cylinder head assembly 22. The engine structure 12 may define cylinders 24, 26 in the engine block 20 housing the pistons 16. A first cylinder 24 is illustrated in FIG. 1 and a second cylinder 26 adjacent to the first cylinder 24 is illustrated in FIG. 2.

A four cylinder engine assembly is illustrated with first and second cylinders 24, 26 described for simplicity. However, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations.

The cylinder head assembly 22 may include a first member 28 coupled to the engine block 20 and a second member 30 coupled to the first member 28. The first member 28 may define intake and exhaust ports. More specifically, a first port 32 may be in communication with the first cylinder 24 (FIG. 1) and a second port 34 may be in communication with the second cylinder 26 (FIG. 2). The first and second ports 32, 34 may each form an intake port. The first member 28 may also define a first exhaust port 36 in communication with the first cylinder 24 (FIG. 1) and a second exhaust port 38 in communication with the second cylinder 26 (FIG. 2). By way of non-limiting example, the arrangement shown in FIGS. 1-3 illustrates a four valve configuration including two intake ports and two exhaust ports for each cylinder. The first member 28 may additionally define lash adjuster oil supply passages 40, 42 and openings 44, 46 intersecting the lash adjuster oil supply passages 40, 42.

The second member 30 may include a first side 48 abutting the first member 28 and facing the engine block 20 and a second side 50 opposite the first side 48. The second side 50 may define a camshaft support surface including cam bearing regions 52. The second member 30 may include a monolithic body defining eight oil supply regions 54, 56, 58, 60, 62, 64, 66, 68 (one for each pair of intake valves and one for each pair of exhaust valves for each cylinder) isolated from one another by walls 70, 72, 74, 76, 78, 80.

The monolithic body may form first and second longitudinally extending portions 31, 33 with cross-members 35 extending laterally between the first and second longitudinally extending portions 31, 33 at the cam bearing regions 52. The first longitudinally extending portion 31 may be located on a first lateral half of the first member 28 of the cylinder head assembly 22 and may define four of the oil supply regions 54, 56, 58, 60 for an intake side of the cylinder head assembly 22. The second longitudinally extending portion 33 may be located on a second lateral half of the first member 28 of the cylinder head assembly 22 and may define four of the oil supply regions 62, 64, 66, 68 for an exhaust side of the cylinder head assembly 22. First and second oil supply regions 54, 56 will be described for simplicity with the understanding that the description applies equally to the remaining oil supply regions 58, 60, 62, 64, 66, 68.

The first oil supply region 54 may include a first recess 82 defined in the first side 48 of the second member 30 and first lash adjuster passages 84. Similarly, the second oil supply region 56 may include a second recess 86 defined in the first side 48 of the second member 30 and second lash adjuster passages 88. A first control passage 92 and a second control passage 94 may be defined between the first and second members 28, 30. The first recess 82 and an adjacent surface of the first member 28 may define the first control passage 92. The second recess 86 and the adjacent surface of the first member 28 may define the second control passage 94. The first and second control passages 92, 94 may be isolated from one another by the wall 70 defined by the second member 30. The combination of the first lash adjuster passage 84 and the opening 44 in the first member 28 may form a first lash adjuster housing 96 and the combination of the second lash adjuster passage 88 and the opening 46 in the second member 30 may form a second lash adjuster housing 98.

The valvetrain assembly 18 will be described relative to one of the ports for each of the first and second cylinders 24, 26 for simplicity. As seen in FIGS. 1 and 2, the valvetrain assembly 18 may include a camshaft 100, a first valve 102, a second valve 104, a first valve lift mechanism 106, a second valve lift mechanism 108, a first lash adjuster 110 and a second lash adjuster 112. The camshaft 100 may be supported for rotation on cam bearing regions 52 located on the second member 30 of the cylinder head assembly 22. The first valve 102 may be located in the first port 32 and the second valve 104 may be located in the second port 34.

The first valve lift mechanism 106 may be supported on the cylinder head assembly 22 and engaged with the first valve 102 and may be in communication with the first control passage 92. Similarly, the second valve lift mechanism 108 may be supported on the cylinder head assembly 22 and engaged with the second valve 104 and may be in communication with the second control passage 94. The first valve lift mechanism 106 may form a first multi-step valve lift mechanism and the second valve lift mechanism 108 may form a second multi-step valve lift mechanism.

In the present non-limiting example, the first lash adjuster 110 is located in the first lash adjuster housing 96 and the second lash adjuster 112 is located in the second lash adjuster housing 98. The first valve lift mechanism 106 may be supported on the first lash adjuster 110 and in communication with the first control passage 92 via the first lash adjuster 110 and the second valve lift mechanism 108 may be supported on the second lash adjuster 112 and in communication with the second control passage 94 via the second lash adjuster 112, as discussed below. The first and second valve lift mechanisms 106, 108 and the first and second lash adjusters 110, 112 may be similar to one another. Therefore, the first valve lift mechanism 106 and the first lash adjuster 110 will be described with the understanding that the description applies equally to the second valve lift mechanism 108 and the second lash adjuster 112.

Figure 5:
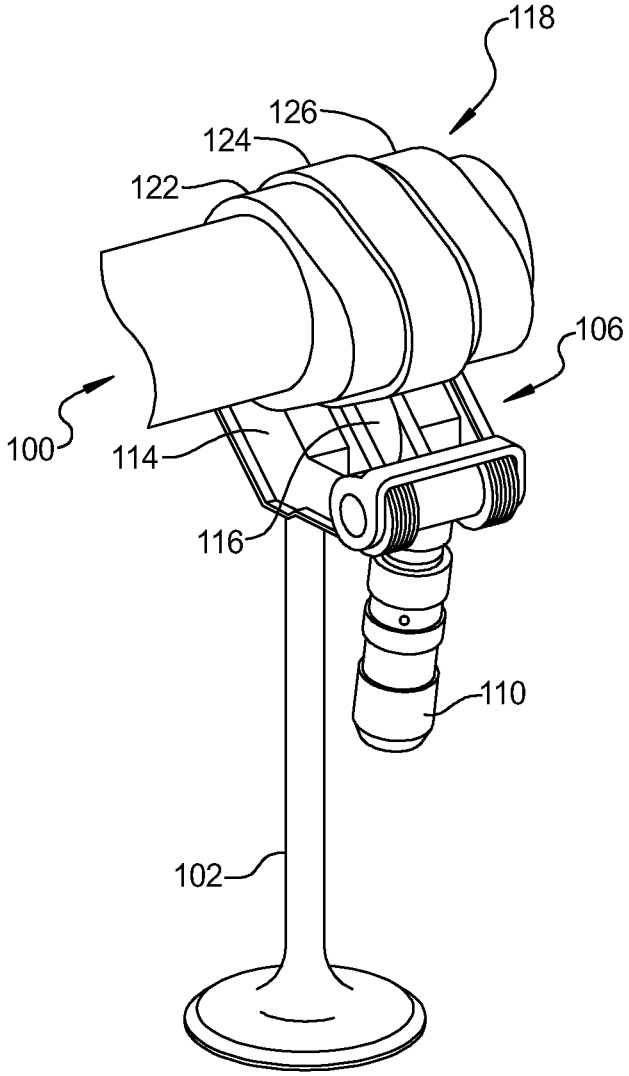
FIG. 5 is a fragmentary perspective view of the engine assembly of FIG. 1.

With additional reference to FIG. 5, the first valve lift mechanism 106 may form a rocker arm including first and second members 114, 116 and a locking mechanism (not shown). The camshaft 100 may include a first lobe member 118 (FIGS. 1 and 5) engaged with the first valve lift mechanism 106 and a second lobe member 120 (FIG. 2) similar to the first lobe member 118 engaged with the second valve lift mechanism 108. The first lobe member 118 may include first, second and third lobes 122, 124, 126. The first and third lobes 122, 126 may be engaged with the first member 114 and the second lobe 124 may be engaged with the second member 116.

The first valve lift mechanism 106 may be operable in a first lift mode and a second lift mode providing a greater displacement of the first valve 102 than the first lift mode. The second valve lift mechanism 108 may also be operable in the first lift mode and the second lift mode. In a first arrangement, the first and second lift modes may each provide some amount of valve opening. In a second arrangement, the first lift mode may include the first valve 102 being maintained in a closed position when the first lobe member 118 engages the first valve lift mechanism 106. Similarly, the second arrangement may include the second valve 104 being maintained in a closed position when the second lobe member 120 engages the second valve lift mechanism 108.

By way of non-limiting example, the first and second members 114, 116 may be secured for displacement with one another via the locking mechanism during the second lift mode and may be displaceable relative to one another during the first lift mode. The first valve lift mechanism 106 may be switched between the first lift mode and the second lift mode by pressurized fluid provided by the first control passage 92 via the first lash adjuster 110. Similarly, the second valve lift mechanism 108 may be switched between the first lift mode and the second lift mode by pressurized fluid provided by the second control passage 94 via the second lash adjuster 112.

Figure 6:
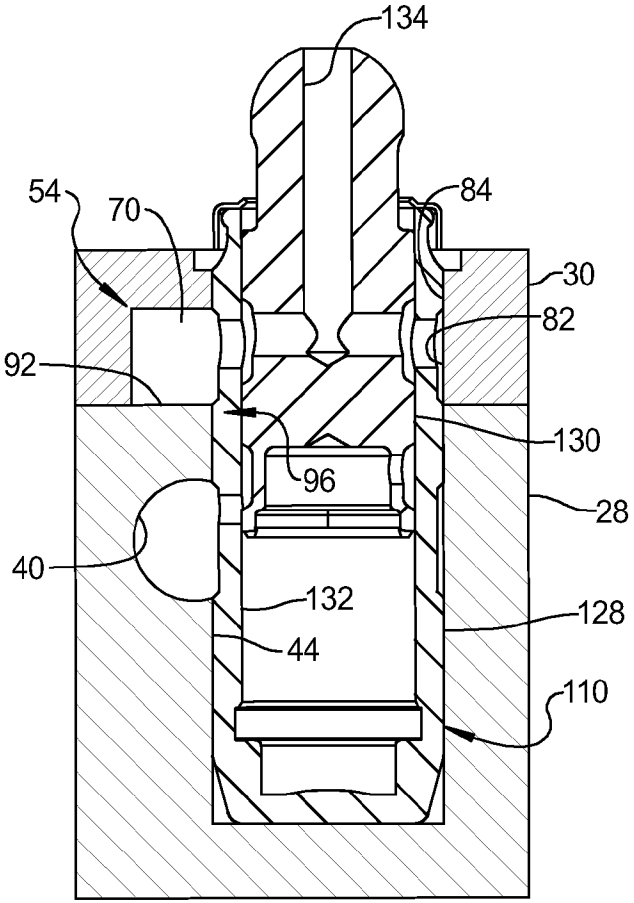
FIG. 6 is a fragmentary section view of the engine assembly of FIG. 1.

As seen in FIG. 6, the first lash adjuster 110 may include an outer body 128 and an inner member 130 axially displaceable within the outer body 128. When the first lash adjuster 110 is located in the first lash adjuster housing 96 and the second lash adjuster is located in the second lash adjuster housing, the lash adjuster oil supply passage 40 may be isolated from the first and second control passages 92, 94. The first and second control passages 92, 94 may be isolated from one another by the wall 70. The combination of the outer body 128 and inner member 130 may form a biasing chamber 132 in communication with the lash adjuster oil supply passage 40. The pressurized oil provided to the biasing chamber 132 from the lash adjuster oil supply passage 40 may bias the inner member 130 outward and into engagement with the first valve lift mechanism 106.

The inner member 130 may define an oil passage 134 in communication with the first control passage 92 and the first valve lift mechanism 106 to provide for actuation of the first valve lift mechanism 106 between the first and second lift modes. During operation, the first and second valve mechanisms 106, 108 may be switched between the first and second lift modes independent from one another due to the isolation of the first and second control passages 92, 94 from one another provided by the wall 70.

Figure 7:
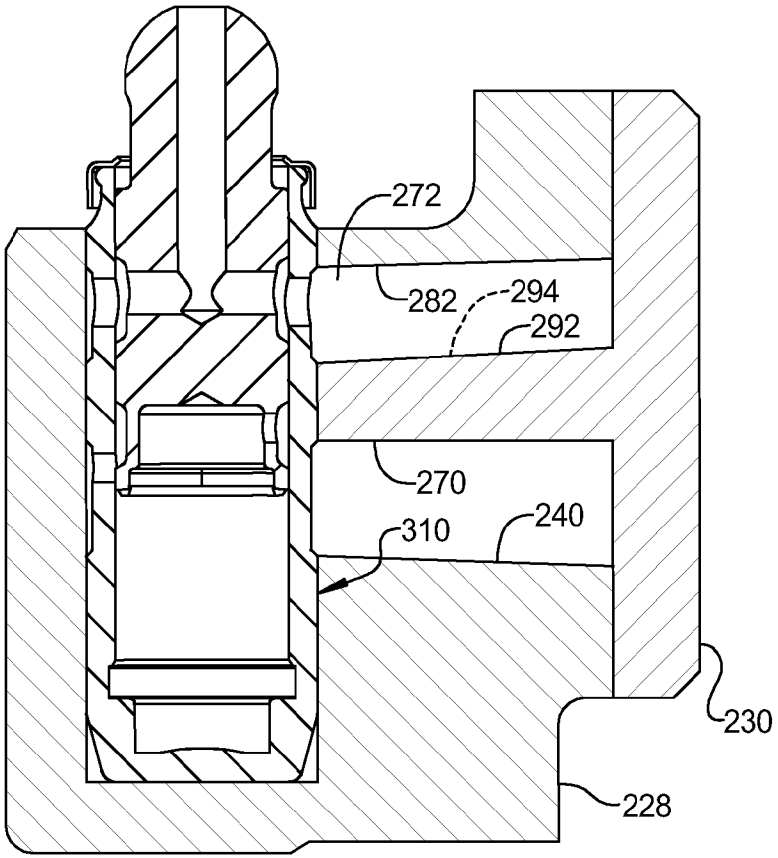
FIG. 7 is a fragmentary section view of an alternate engine assembly according to the present disclosure.

An alternate arrangement is illustrated in FIG. 7. FIG. 7 illustrates an arrangement where a recess 282 is defined in a side surface of the first member 228. The second member 230 may extend along the side surface of the first member 228. The combination of the recess 282 and the second member 230 may form the first and second control passages 292, 294 and the lash adjuster oil supply passage 240. More specifically, the second member 230 may include first and second walls 270, 272. The first wall 270 may extend into the recess 282 and abut the first lash adjuster 310 to isolate the first and second control passages 292, 294 from the lash adjuster oil supply passage 240. Similarly, the second wall 272 may extend into the recess 282 to isolate the first and second control passages 292, 294 from one another.

What is claimed is:

1. A cylinder head assembly comprising:

a first member defining a first port for communication with a first cylinder in an engine block and a second port for communication with a second cylinder in the engine block, the first and second cylinders each having a center that lie on a longitudinal line; and a second member coupled to the first member, the second member defining a longitudinally extending portion located on a first lateral half of the first member completely offset from the longitudinal line, the longitudinally extending portion having a surface including a first oil supply region that defines a first control passage between the first member and the longitudinally extending portion of the second member and a second oil supply region that defines a second control passage between the first member and the longitudinally extending portion of the second member, the first and second control passages being completely offset from the longitudinal line, and the surface of the second member defining a wall separating the first oil supply region from the second oil supply region and thereby isolating the first control passage from the second control passage, wherein the longitudinally extending portion of the second member defines a first lash adjuster housing intersecting the first control passage and a second lash adjuster housing intersecting the second control passage.

2. The cylinder head assembly of claim 1, wherein the first member of the cylinder head assembly defines a lash adjuster oil supply passage that provides oil to a first biasing chamber defined in a first hydraulic lash adjuster located in the first lash adjuster housing and a second biasing chamber defined in a second hydraulic lash adjuster located in the second lash adjuster housing.

3. The cylinder head assembly of claim 2, wherein the lash adjuster oil supply passage is isolated from the first control passage and the second control passage.

4. The cylinder head assembly of claim 1, wherein the longitudinally extending portion of the second member includes a first side facing the first member and defining a first recess and a second recess with the wall located between and separating the first recess from the second recess, the first control passage being defined by the first recess and an adjacent surface of the first member and the second control passage being defined by the second recess and the adjacent surface of the first member.

5. The cylinder head assembly of claim 4, wherein the second member includes a second side opposite the first side and defining a camshaft support surface.

6. The cylinder head assembly of claim 1, wherein the first port forms a first intake port and the second port forms a second intake port.

7. The cylinder head assembly of claim 1, wherein the second member of the cylinder head assembly is a monolithic body including the wall isolating the first control passage from the second control passage.

8. The cylinder head assembly of claim 1, wherein the first member includes a side surface defining a recess and the second member extends along the side surface, the second member and the recess defining the first control passage and a lash adjuster oil supply passage isolated from the first control passage.

9. An engine assembly comprising:

an engine block defining a first cylinder and a second cylinder, the first and second cylinders each having a center that lie on a longitudinal line;

a cylinder head assembly including:

a first member coupled to the engine block and defining a first port in communication with the first cylinder and a second port in communication with the second cylinder; and a second member coupled to the first member, the second member defining a longitudinally extending portion located on a first lateral half of the first member completely offset from the longitudinal line, the longitudinally extending portion having a surface including a first oil supply region that defines a first control passage between the first member and the longitudinally extending portion of the second member and a second oil supply region that defines a second control passage between the first member and the longitudinally extending portion of the second member, the first and second control passages being completely offset from the longitudinal line, and the surface of the second member defining a wall separating the first oil supply region from the second oil supply region and thereby isolating the first control passage from the second control passage;

a first valve located in the first port and a second valve located in the second port;

a first valve lift mechanism supported on the cylinder head assembly, engaged with the first valve and in communication with the first control passage;

a second valve lift mechanism supported on the cylinder head assembly, engaged with the second valve and in communication with the second control passage; and a camshaft supported on the cylinder head assembly and engaged with the first valve lift mechanism and the second valve lift mechanism.

10. The engine assembly of claim 9, wherein the first valve lift mechanism is a multi-step valve lift mechanism operable in a first lift mode and a second lift mode providing a greater displacement of the first valve than the first lift mode.

11. The engine assembly of claim 10, wherein the second valve lift mechanism is a multi-step valve lift mechanism operable in the first lift mode and the second lift mode.

12. The engine assembly of claim 11, further comprising a first hydraulic lash adjuster located within a first lash adjuster housing defined in the longitudinally extending portion of the second member and intersecting the first control passage and a second hydraulic lash adjuster located within a second lash adjuster housing defined in the longitudinally extending portion of the second member and intersecting the second control passage, the first hydraulic lash adjuster supporting the first valve lift mechanism and defining a first fluid path from the first control passage to the first valve lift mechanism to switch the first valve lift mechanism between the first lift mode and the second lift mode and the second hydraulic lash adjuster supporting the second valve lift mechanism and defining a second fluid path from the second control passage to the second valve lift mechanism to switch the second valve lift mechanism between the first lift mode and the second lift mode.

13. The engine assembly of claim 12, wherein the first member of the cylinder head assembly defines a lash adjuster oil supply passage in communication with a biasing chamber defined in the first hydraulic lash adjuster and a biasing chamber defined in the second hydraulic lash adjuster.

14. The engine assembly of claim 13, wherein the lash adjuster oil supply passage is isolated from the first control passage and the second control passage.

15. The engine assembly of claim 9, wherein the longitudinally extending portion of the second member includes a first side facing the first member and defining a first recess and a second recess with the wall located between and separating the first recess from the second recess, the first control passage being defined by the first recess and an adjacent surface of the first member and the second control passage being defined by the second recess and the adjacent surface of the first member.

16. The engine assembly of claim 15, wherein the first side of the second member faces the engine block and the camshaft is supported for rotation on a second side of the second member opposite the first side.

17. The engine assembly of claim 9, wherein the first port forms a first intake port and the second port forms a second intake port.

18. The engine assembly of claim 9, wherein the second member of the cylinder head assembly is a monolithic body including the wall isolating the first control passage from the second control passage.

19. The engine assembly of claim 9, wherein the first member includes a side surface defining a recess and the second member extends along the side surface, the second member and the recess defining the first control passage and a lash adjuster oil supply passage isolated from the first control passage.

* * * * *